United States Patent [19]

Schuster

[11] 4,095,714

[45] Jun. 20, 1978

[54] LOAD TILTING ATTACHMENT FOR AN INDUSTRIAL TRUCK

[75] Inventor: Frank C. Schuster, Peoria, Ill.

[73] Assignee: Little Giant Products, Inc., Peoria, Ill.

[21] Appl. No.: 739,830

[22] Filed: Nov. 8, 1976

[51] Int. Cl.[2] ..... B66F 9/14

[52] U.S. Cl. ..... 214/620; 214/701 Q; 214/731

[58] Field of Search ..... 214/1 Q, 620, 652, 701 R, 214/701 Q, 730, 731, 768; 308/31, 63, 189 A, 239

[56] References Cited

U.S. PATENT DOCUMENTS

| | | | |
|---|---|---|---|
| Re. 26,369 | 4/1968 | Ellis | 214/652 |
| 2,473,659 | 6/1949 | Musgrave | 214/701 Q |
| 2,635,774 | 4/1953 | Backofen et al. | 214/652 |
| 2,690,272 | 9/1954 | Quayle | 214/701 Q |
| 3,086,670 | 4/1963 | Cuendet | 214/701 R |
| 3,203,567 | 8/1965 | Huitfeldt | 214/652 |
| 3,482,722 | 12/1969 | Simovich | 214/701 R |

FOREIGN PATENT DOCUMENTS

| | | | |
|---|---|---|---|
| 615,265 | 1/1949 | United Kingdom | 214/652 |
| 1,007,052 | 10/1965 | United Kingdom | 308/239 |

*Primary Examiner*—L. J. Paperner

[57] ABSTRACT

A load tilting attachment for an industrial truck having an upstanding mast and a carriage vertically movable on the mast, said attachment including: a vertically disposed stationary plate secured to the carriage, the plate having a bearing for supporting a load on the carriage through the plate, and load reaction members radially spaced from the bearing; a vertically disposed body aligned with the plate, the body having secured to one face thereof a pivot spindle projecting from the body into and pivotable on the bearing, and second load reaction members on said one face radially disposed from said spindle movable on and cooperating with the plate reaction members; a piston-cylinder assembly connecting the plate and body for pivoting the spindle on the bearing and moving the body reaction members relative to the plate reaction members to tilt the body on the plate; and a load supporting member on the body. The attachment may also include a hydraulically actuated clamp on the body for manipulating the load supporting member to grasp a load.

9 Claims, 4 Drawing Figures

LOAD TILTING ATTACHMENT FOR AN INDUSTRIAL TRUCK cl BACKGROUND AND SUMMARY OF THE INVENTION

This invention relates to improvements in attachments for industrial trucks, particularly lift trucks, having an upstanding mast and a carriage vertically movable on the mast, and is particularly concerned with novel means for tilting the load from side to side in a vertical plane to locate the load supporting member relative to a canted load or canted means for engaging the load during pick-up or discharge of the load. The tilting mechanism may be utilized with load clamping or side shifting mechanism without substantial loss of load center.

Conventionally, twisting or turning of the load supporting member relative to a surface is accomplished by use of a hydraulic rotator; however, such conventional rotators usually utilize sohpisticated means for rotation, involving not only expensive and heavy duty hydraulics and bearings but also substantial lost load center. Frequently, it is not necessary to fully rotate the load, as tilting less than 45°, usually in the area of 30°–40°, will suffice for the desired manipulation, particularly where a clamp is employed. A device embodying the improvements of this invention may accomplish that tilting result without use of a rotator and with minimum lost load center.

In the present invention, a vertically disposed stationary plate is secured to the lift truck carriage for movement in a vertical direction therewith, and the plate has a bearing for supporting a load on the carriage therethrough and load reaction members radially spaced from the bearing. A body aligned with the plate, having projecting therefrom a pivot spindle secured in and pivotable on the bearing and second load reaction members radially disposed from the spindle movable on and cooperating with the plate load reaction members, is tiltably connected to the plate through a piston-cylinder assembly. Load supporting members, which may include hydraulically actuated clamp or side-shifter mechanism, are secured to the body.

The structure embodying the present invention utilizes the strength of the lift truck carriage and the space above the carriage to minimize lost load center, while utilizing a relatively thin stationary plate for bearing the load. The bearing-spindle arrangement supports downward weight of the load, and the tilt function is tracked through the cooperating load reaction members, which may include adjustable wear strips, thereby compensating for sag and load deflection forces. Pivotal force for tilting the load is provided through a single hydraulic cylinder. Hydraulically actuated clamp, side shifting and fork spreading mechanism may be provided on the tilt body to manipulate the load as desired

OBJECTS OF THE INVENTION

It is therefore an object of the invention to provide a structure of the character referred to.

Another object is to provide a novel bearing plate and tilt body for a lift truck attachment.

Another object is to provide novel cooperating load reaction members for tilting a load supporting member on a lift truck carriage.

Another object is to provide piston-cylinder means and novel connections therefor to provide pivotal force for tilting a load supporting tilt body on a carriage mounted plate.

Another object is to provide adjustable wear resistant tracking means for tilting a load on a bearing member.

Another object is to provide a load tilting body including load grasping means and a bearing arrangement therefor with minimum lost load center.

Another object is to provide a load tilting attachement for a lift truck having a vertically movable carriage which utilizes the strength of the carriage for supporting the load.

Another object is to provide an assembly of the character referred to which is not expensive to construct, each and inexpensive to retain serviceable and very efficient in use.

Other objects and advantages of the present invention will become apparent with reference to the following description and the accompanying drawings.

DESCRIPTION OF A PREFERRED EMBODIMENT

Figure 1:
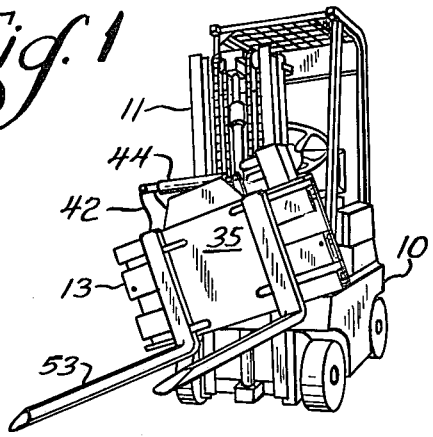
FIG. 1 is a perspective view of a lift truck having mounted thereon a tilt clamp embodying the present invention.
Figure 3:
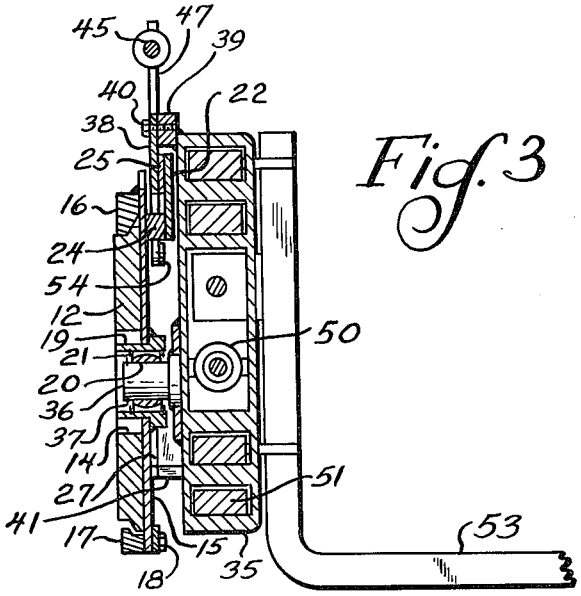
FIG. 3 is a vertical sectional view of the tilt clamp shown in FIG. 2, taken on line 3 — 3 of FIG. 2.
Figure 2:
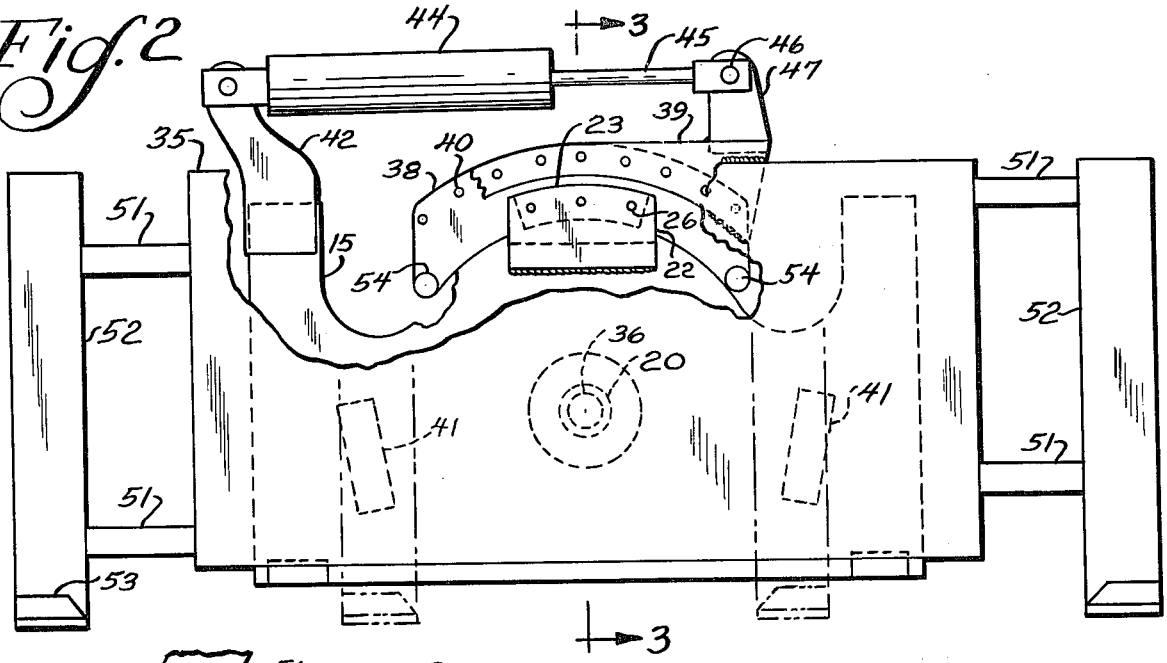
FIG. 2 is a front elevational view of the tilt clamp, parts thereof being broken away.
Figure 4:
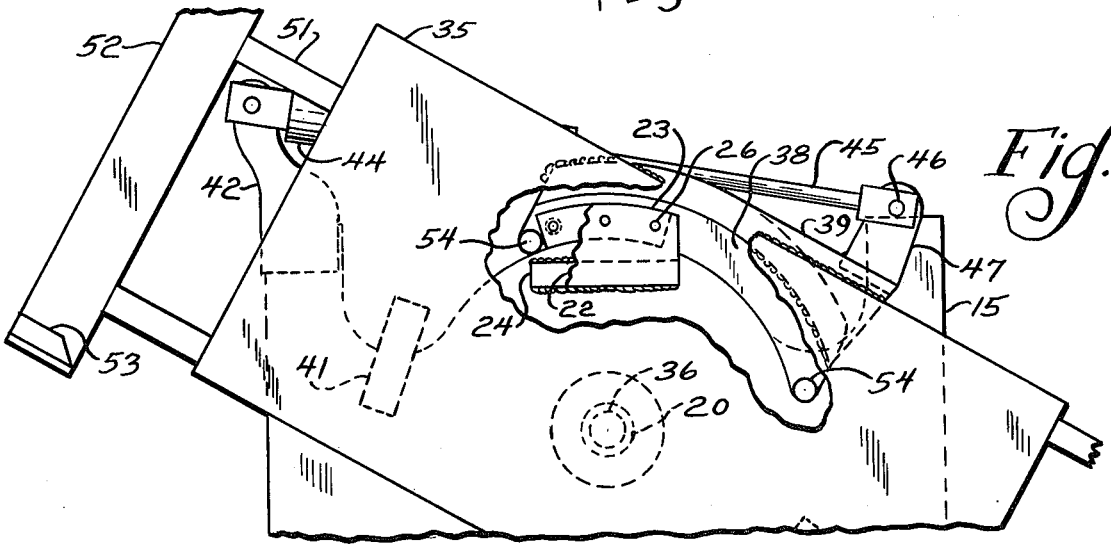
FIG. 4 is a front elevational view similar to FIG. 2, except showing the mechanism during tilting.

Referring now to the exemplary embodiment of the invention shown in the accompanying drawings, a conventional industrial lift truck 10 having an upstanding mast 11 mounts a carriage 12 for vertical movement along the mast, and has secured to the carriage a tilt clamp 13 embodying the present invention.

The tilt clamp 13 has a vertically disposed plate 15, which is secured to the upper and lower margins of the carriage 12 by upper and lower shaped bars 16 and 17, respectively, upper bar 16 being welded to the plate and hooked over the carriage, and lower bar 17 being secured to the plate over the lower edge of the carriage by bolts 18. Carriage 12 has a space 14 therein, into which projects a bearing block 19 on the plate 15, which carries a spherical bearing 20, held in place by retaining rings 21.

Spaced outwardly radially from the bearing 20 are plate load reaction members, the upper reaction member 22 comprising an upstanding hook-like element having an arcuate upper surface 23 spaced from the plate 15 by spacer 24, the spacer and element being welded securely to the plate, and the hook-like element may have secured to the face thereof a wear strip 25, which may be mounted thereon by screws 26. Adjustable wear strips 27 may act as load reaction members for carrying the body reaction members in a manner to be described.

The tilt body 35 carries a spindle 36, which projects outwardly from the body and into the bearing 20, where it is retained in place by a retaining ring 37. On the upper margin of the rear face of the body 35 is an arcuate plate member 38 secured to a spacer plate 39, as by bolts 40, and welded to the body 35. This arcuate plate 38 interlocks into theupper reaction member 22 of the plate 15.

The body 35 also has secured to it, preferably by welding, lower reaction members 41, each preferably angularly disposed to the spindle-bearing assembly, as to provide a laterally separated three-point suspension with the centrally located arcuate plate 38. The bearing surface of the lower load reaction members 41 may be carried upon the adjustable wear strips 27 of the plate 15, or the wear strips may be fastened to the bearing edge of the lower load reaction members.

Extending upwardly from the plate 15 is an arm 42, on the free end of which is a pivot connected to the piston 44 of a hydraulic piston-cylinder assembly, the free end of the piston rod 45 of which is pivotally connected, at 46, to an arm 47 upstanding from one end of the body arcuate plate member 38.

The body 35 may contain a horizontally disposed cylinder assembly 50 which drives clamp slide bars 51, connected to clamp arms 52, which may carry load support forks 53, toward and away from one another, as shown, or in unison from side to side.

Stops 54 may be provided at each end of the arcuate plate 38 to prevent over tilting when the plate load reaction member 22 comes into contact with either stop during the canting operation.

In operation, movement of the piston-cylinder assembly 44–45 causes the body 35 to tiltably pivot on the plate 25 at the spindle-bearing connection 20–35 in an arc defined by the upper load reaction member 22 and arcuate plate 38. Sagging and load deflection is avoided and proper tracking is assured by the bearing of the lower load reaction members 41 on the plate 15. The spindle-spherical bearing assembly 20–35 also supports downward weight of the load, compensates for load deflection and wear on the wear strips, and provides anti-friction engagement for the tilt function. The plate 15 may be relatively thin, as it is not a strength member and utilizes the lift truck carriage to support the bearing, load reaction and pivoted members, although where the tilt clamp is attached to a shaft-type fork mounted carriage the plate can be strengthened to act as a support member.

Although a preferred embodiment of the invention has been described in considerable detail, it will be understood that the description thereof is intended to be illustrative and not restrictive, as details of the structure may be modified or changed without departing from the spirit or scope of the invention. Accordingly, it is not desired that the invention be restricted to the exact construction described and shown.

I claim:

1. In a load tilting attachment for an industrial truck having a vertically movable carriage and load supporting means, said tilting arrangement comprising: a vertically disposed plate secured to and movable with said carriage, a vertically disposed tilt boy aligned with said plate, means for tilting said body in a limited arc relative to and parallel with said plate, said tilting means consisting of a spindle-bearing assembly centrally of said plate and said body for pivoting said body in a vertically disposed arc, circumferentially spaced load reaction members between said plate and said body and spaced radially from said spindle-bearing assembly for restraining rocking movement of said body relative to said plate, one of said load reaction members comprising an arcuate plate secured to said tilt body above said spindle-bearing assembly and an associated bearing plate secured to said vertically disposed plate and against which said arcuate plate bears, said arcuate plate and said bearing plate being interlocked in a hook-like arrangement to resist outward and axial rocking movement between them under load, means connecting said plate and said body for driving said body about said pivot in said arc, and means connecting said load supporting means to said body.

2. In the load tilting attachment recited in claim 1, wherein said spindle-bearing assembly projects into an area defined by the vertical plane of said carriage

3. In the load tilting attachment recited in claim 1, wherein the said connecting means includes mechanism secured to said body for manipulating said load supporting means.

4. In the load tilting attachment recited in claim 3, wherein said mechanism comprises a slide bar assembly movable horizontally laterally to said body and a piston cylinder assembly connected to said slide bar assembly, said slide bar assembly being connected to said load supporting means for moving said load supporting means laterally of said body upon actuation of said piston cylinder assembly.

5. In the load tilting attachment recited in claim 4, wherein said slide bar assembly and said load supporting means each comprises at least a pair of like members, said slide bar assembly members being spaced apart vertically within said body and said load supporting members being spaced apart and connected one to one end of each said slide bar assembly members, said piston-cylinder assembly being connected to each of said slide bar assembly members to move said load supporting members toward and away from one another.

6. In the load tilting attachment recited in claim 1, wherein said body has stop means at each end of said arcuate plate cooperating with means on the vertically disposed plate for limiting tilting movement of said body relative to said vertically disposed plate.

7. In the load tilting attachment recited in claim 1, wherein a pair of said load reaction members each comprises a bar projecting between said plate and body, and said bars are located on opposite sides of said spindle-bearing assembly.

8. In the load tilting attachment recited in claim 1, wherein said load reaction members have removably secured adjustable wear strips.

9. In the load tilting attachment recited in claim 1, wherein said vertically disposed plate and said tilt body each have an upwardly extending arm and said connecting driving means comprises a piston-cylinder assembly pivotally connected between said arms.

* * * * *